US007794380B2

(12) United States Patent
Baker

(10) Patent No.: US 7,794,380 B2
(45) Date of Patent: Sep. 14, 2010

(54) PRE-OPENED RESEALABLE BAGS

(75) Inventor: Tony D Baker, Hudson, OH (US)

(73) Assignee: Advanced Poly-Packaging, Inc., Akron, OH (US)

( * ) Notice: Subject to any disclaimer, the term of this patent is extended or adjusted under 35 U.S.C. 154(b) by 349 days.

(21) Appl. No.: 10/778,276

(22) Filed: Feb. 13, 2004

(65) Prior Publication Data

US 2004/0162205 A1 Aug. 19, 2004

Related U.S. Application Data

(62) Division of application No. 09/705,051, filed on Nov. 2, 2000, now abandoned.

(51) Int. Cl.
*B31B 1/90* (2006.01)

(52) U.S. Cl. ..... 493/212; 493/213; 493/927

(58) Field of Classification Search ..... 493/212, 493/114, 213, 394, 927, 214
See application file for complete search history.

(56) References Cited

U.S. PATENT DOCUMENTS 3,113,492 A * 12/1963 Foss ..... 493/67
3,210,910 A * 10/1965 Seefluth ..... 53/329.4
4,709,398 A 11/1987 Ausnit
4,876,842 A * 10/1989 Ausnit ..... 53/410
4,923,309 A * 5/1990 VanErden ..... 383/5
5,007,744 A 4/1991 Scarberry et al.
5,118,202 A 6/1992 Bruno
5,823,933 A * 10/1998 Yeager ..... 493/213
6,007,244 A * 12/1999 Dinder ..... 383/24
6,068,585 A * 5/2000 Ouchi ..... 493/213
6,115,892 A 9/2000 Malin et al.
6,698,928 B2 * 3/2004 Miller ..... 383/205
7,093,978 B2 * 8/2006 Tan ..... 383/37

FOREIGN PATENT DOCUMENTS

JP 4-57435 1/1992

* cited by examiner

*Primary Examiner*—Sameh H. Tawfik
(74) *Attorney, Agent, or Firm*—Renner, Kenner, Greive, Bobak, Taylor & Weber

(57) ABSTRACT

A series of pre-opened resealable bags formed as a continuous web and received on a roll suitable for implementation in an automatic bagging machine are presented. The web of bags consist of top and bottom films thermally bonded together along the edges thereof. Transverse resealable zipper strips are interposed between the top and bottom films, with mating portions thereof respectively bonded to an associated films. A top film is provided with a filling slit, adapted for receiving product or materials therethrough. Appropriate seals and perforations are provided transverse to the web to allow the bags to be separated from each other and to allow for operator access to the resealable zipper strip. In another embodiment, the zipper strips are substituted or supplemented with plastic reinforcing strips to accommodate a punched hold for hanging display of the bag. A process for manufacturing such bags from a pair of webs received inserted zipper strips is also presented.

3 Claims, 2 Drawing Sheets

PRE-OPENED RESEALABLE BAGS

RELATED PATENT APPLICATIONS

This is a divisional application of U.S. patent application Ser. No. 09/705,051, filed Nov. 2, 2000, now abandoned.

TECHNICAL FIELD

The invention herein resides in the art of packaging materials and, more particularly, to bags for use in automatic bagging machines. Specifically, the invention relates to bags having a resealable zippered seal at one end thereof and a slit opening at an opposite end thereof and interconnected in a web maintained in a roll for use in such automatic bagging equipment. The bags further have reinforcing strips to accommodate hang holes for display.

BACKGROUND ART

Automatic bagging equipment is now well known and widely used. Such equipment typically employs pre-opened bags maintained in a web that is fed from either a box or a roll to a loading station where goods or materials are placed into the pre-opened bags and the bags are subsequently sealed and separated from the web. The bags are sequentially indexed to the loading station.

In accordance with the prior art, the bags employed in automatic bagging machines are typically not reusable. These bags, typically made of an appropriate polymeric film, are generally torn open by the user to make access to the materials therein, and such bags are not given to being resealed or reused.

In recent years, it has become quite popular to provide certain materials in resealable or reusable bags. These bags are often characterized by the presence of a "zipper seal" at an end thereof which allows the user to access the interior of the bag by simply separating tongues and grooves of the zipper seal and then subsequently resealing the bag by reengaging such tongues and grooves. Such bags have been widely accepted and broadly employed, but are not conducive to implementation with automatic bagging machines. Such bags are not provided on a roll or any continuous web, but rather are separately and individually manufactured, handled, filled and sealed.

There remains a need in the art for pre-opened resealable bags that are conducive to utilization with presently known automatic bagging machines.

DISCLOSURE OF INVENTION

In light of the foregoing, it is a first aspect of the invention to provide pre-opened resealable bags maintained in a continuous web.

Another aspect of the invention is to provide pre-opened resealable bags maintained in a continuous web formed into a roll.

Still another aspect of the invention is to provide pre-opened resealable bags conducive to implementation with automatic bagging equipment.

Yet a further aspect of the invention is the provision of pre-opened resealable bags having a zipper lock.

Still a further aspect of the invention is the provision of a method for manufacturing pre-opened resealable bags in which a pair of film webs are joined together with zipper lock strips interposed therebetween and spaced therealong.

Another aspect of the invention is the provision of a method for making pre-opened resealable bags in which bags having zipper lock strips are formed in a web and retained in a roll.

An additional aspect of the invention is the provision of a method for making pre-opened bags in which the bags are formed with a reinforcing strip bonded to and between the sides of the bag proximate an end thereof.

The foregoing and other aspects of the invention which will become apparent as the detailed description proceeds are achieved by bags for use in packaging equipment, comprising: a continuous web of a top film and a bottom film interconnected at side edges to each other; a plurality of inserts traversing said web in spaced separation therealong, each said insert having a first side bonded to said top film and a second side bonded to said bottom film; and a plurality of openings within said top film traversing said web in spaced separation therealong.

Other aspects of the invention are attained by a method for making bags for use in packaging equipment, comprising: feeding top and bottom webs of film along a line in juxtaposition to each other; inserting plastic seal strips between said top and bottom webs of film and transverse thereto at spaced apart locations; sealing selected areas of said top and bottom webs of film to each other and bonding respective portions of said plastic strips to said top and bottom webs of film, defining a composite web; and winding said composite web into a roll.

BRIEF DESCRIPTION OF THE DRAWINGS

For a complete understanding of the objects, techniques and structure of the invention, reference should be made to the following detailed description and accompanying drawing wherein.

BEST MODE FOR CARRYING OUT THE INVENTION

Figure 1:
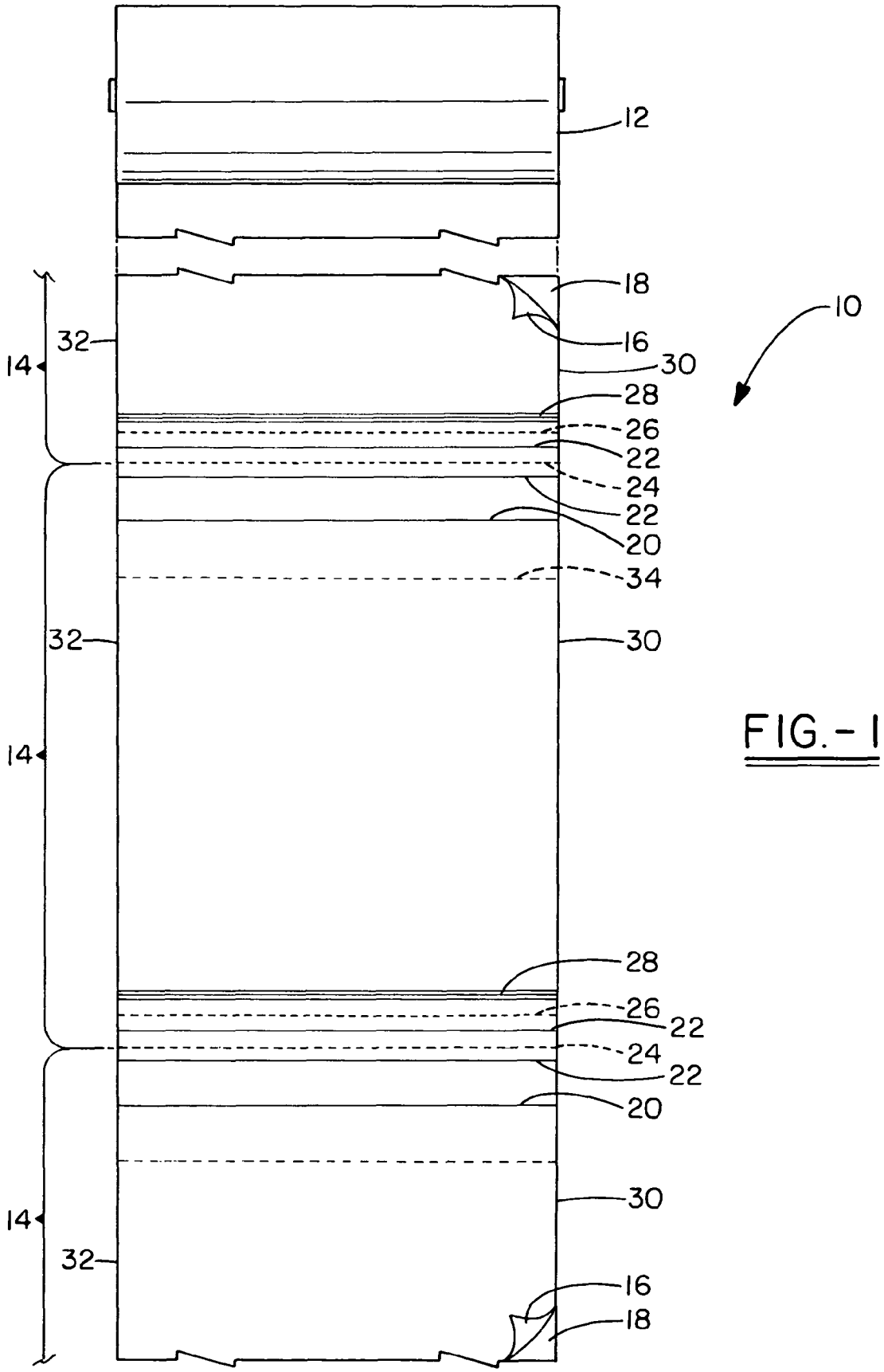
FIG. 1 is a top plan view of a web of pre-opened resealable bags according to the invention.

Referring now to the drawings and more particularly FIG. 1, it can be seen that a web of pre-opened resealable bags made in accordance with the invention is designated generally by the numeral 10. The web of bags 10 is maintained upon and fed from a roll 12 configured to be received by a standard automatic bagging machine such that individual bags of the web 10 may be indexed, filled, sealed and separated at an appropriate station in the bagging machine. Such concept is well known and understood by those in the packaging art.

The web 10 consists of a plurality of bags 14 serially interconnected with each other. Those skilled in the art will readily appreciate that the bags 14 may have any of various configurations of size, length, seals, perforations and the like. The bags 14 of the web 10 are shown herein for illustrative and representative purposes only.

Figure 2:
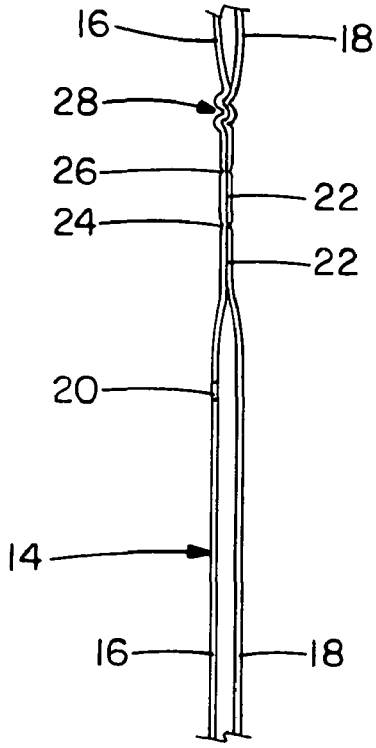
FIG. 2 is a side elevational view of a portion of the web of bags shown in FIG. 1.

With reference now to FIGS. 1 and 2, it can be seen that the web 10 consists of a top film 16 and a bottom film 18, bonded to each other continuously along the lateral edges thereof. The films 16, 18 are preferably polymeric films, such as polyvinyl chloride or the like. Moreover, while the web 10 may be formed of separate top and bottom films 16, 18, the invention also contemplates an integral tubular member, formed in standard fashion as by film blowing or the like.

Slits or openings 20 transverse top film 16 in uniform spaced relationship. Those skilled in the art will appreciate that the slits or openings are provided to allow an operator or automated device to make access to the interior of a bag for purposes of filling the bag. Spaced a short distance from the slits or openings 20 are seals 22 which traverse the web 10 and bond the films 16, 18 together. Such bonding can be achieved thermally or by any appropriate means as would be understood by those skilled in the art. The bonding is achieved between the pair of parallel lines shown in FIG. 1 as identifying the boundaries of the bonded band seal 22. Also traversing the web 10 within the band of each of the seals 22 are perforations 24. The perforations 24 define the top and bottom boundaries of adjoining bags and allow for the separation of the bags from each other. While perforations are preferred, the invention contemplates any means for achieving the desired separation.

Also traversing the web 10 and passing through both the top and bottom films 16, 18 are perforations 26. The perforations 26 pass through the films 16, 18 beyond the area of the seal 22, in an area where the films 16, 18 are not bonded or fused together. The perforations 26 allow for transverse tearing of the top and bottom films 16, 18 to make access to a resealable zipper lock 28 positioned adjacent thereto. Such resealable zipper locks are well known and understood by those skilled in the art and typically comprise mating grooves and tongues or troughs and ribs and are generally made of an appropriate polymeric material. According to the invention, one of the mating portions of the resealable zipper lock 28 is bonded to the top film 16, while the other mating portion is bonded to the bottom film 18. Again, such bonding may be achieved in any of numerous ways, although thermal bonding as by the application of a heated die is preferred.

As mentioned above, the web 10 is completed by seals 30, 32 continuously along the lateral edges thereof. Of course, and as previously mentioned, the web 10 may otherwise constitute an integral tube of blown polymeric film.

In use of the web of pre-opened resealable bags 10, the roll 12 is placed upon a spindle or the like in an automatic bagging machine and the web 10 fed through the machine and to a filling head or station. With a bag 14 positioned at the filling station, blown air or the like is typically introduced to open the slit 20 to allow access to the interior of the bag 14. Material is then inserted through a funnel or the like and the bag is then sealed, as by a heated platen, bar or the like, as at 34. It is contemplated that the seal 34 may also sever the bag 14 from the web 10. Alternatively, the bag may be separated as by the perforations 24 within the bonded seal 22. The next bag is then indexed into position for filling in like manner. It will thus be appreciated that each of the filled bags 14 is effectively filled from the bottom, with the resealable zipper lock 28 being at the actual top of the bag. Access to the zipper lock is precluded by a portion of the bonded seal 22 remaining after separation along the perforated lines 24. Access to the zipper lock can then be made by removal of the top portion of the bag along the perforations 26, leaving exposed and unbonded lips of the top and bottom films 16, 18. The user simply grips the lips and pulls them apart in standard fashion, causing separation of the zipper lock 28 which, in standard fashion, may be subsequently resealed by simply drawing the zipper lock 26 between a finger and thumb.

Figure 3:
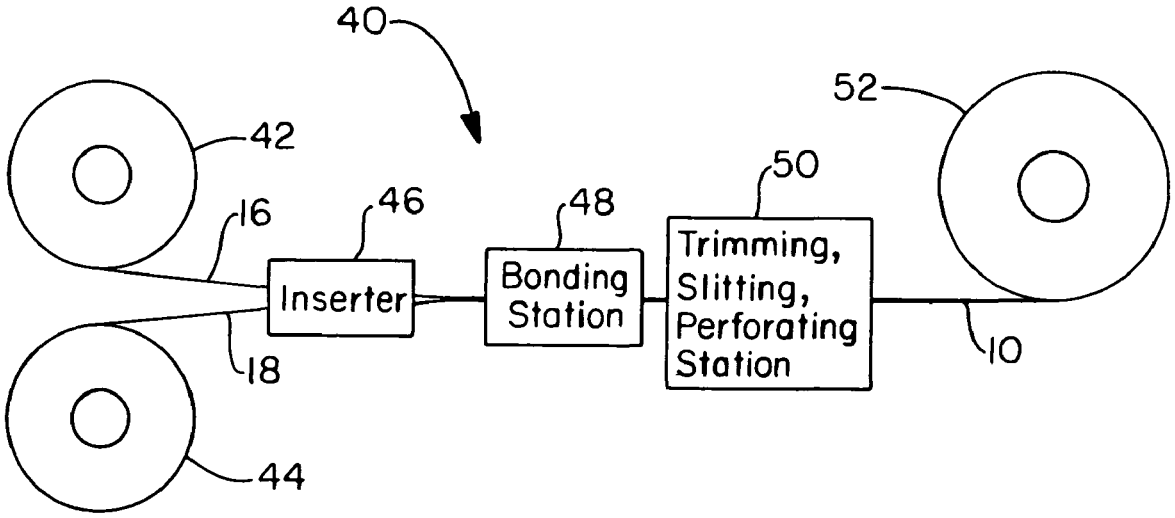
FIG. 3 is an illustrative diagram of the manufacturing process of the invention.

With reference now to FIG. 3, an appreciation can be obtained of a method by which the web of pre-opened resealable bags 10 may be prepared. There, the system adapted for implementation of the process is designated generally by the numeral 40. As shown, a roll 42 of top film 16 and a roll 44 of bottom film 18 are positioned to feed respective webs in close juxtaposition to each other along a processing line. Resealable zipper strips 28 are inserted between the webs 16, 18 by the inserter 46. Of course, such insertion takes place at predetermined intervals such that the resealable zipper strips are uniformly positioned along the continuous web. At a bonding station 48, consisting of heated platens, heated dies, and the like, the sides 30, 32 of the webs 16, 18 are thermally bonded together, the flaps of the zipper strips 28 are bonded to respective ones of the webs 16, 18, and the seals 22 are imparted. The web continues to trimming, slitting and perforating station 50, where any extending edges of the zipper strips 46 are trimmed to be collinear with the side seals of the web 16, 18, the slip 20 is imparted to the top film 16 and the perforations 24, 26 are introduced. The finished web 10, as illustrated in FIG. 1, is then received on a take-up roll 52, ready for use in an automatic bagging machine.

The invention further contemplates that structures other than resealable zipper locks 28 may be inserted between the webs 16, 18 by the inserter 46. A reinforcing strip, rather than or in addition to the zipper locks may be so interposed. Such a reinforcing strip would be of uniform thickness plastic, and of a width approximately that of the zipper lock 28. When inserted and bonded to and between the webs 16, 18, the resultant laminae may be punched therethrough to form a hole from which the associated bag 14 may be hung for sale or display.

Accordingly, the instant invention contemplates that the element 28 may be just a reinforcing strip, or a zipper lock. The invention further contemplates that a single bag 14 may include both a reinforcing strip and a zipper lock separately disposed between the webs 16, 18 by the inserter 46.

Thus it can be seen that the objects of the invention have been satisfied by the structure presented herein above. While in accordance with the patent statutes only the best mode and preferred embodiment of the invention has been presented and described in detail, the invention is not limited thereto or thereby. Accordingly, for an appreciation of the scope and breadth of the invention reference should be made to the following claims.

What is claimed is:

1. A method for making resealable bags for use in packaging equipment, comprising:

feeding top and bottom webs of film along a line in juxtaposition to each other;

inserting zipper seal strips between said top and bottom webs of film and transverse to said webs of film at spaced apart locations;

sealing selected areas of said top and bottom webs of film to each other and bonding respective portions of said zipper seal strips to said top and bottom webs of film, defining a composite web of interconnected resealable bags, each having a zipper seal strip at a first end thereof;

transversely slitting only one of said webs of film of each bag to provide a filling opening for each bag through only one side thereof, said filling opening of each bag being parallel to said zipper seal strip of said bag and at a second opposite end thereof; and winding into a roll said composite web of interconnected resealable bags, each bag having a filling opening through only one side thereof.

2. The method for making resealable bags according to claim 1 further comprising the step of trimming said zipper seal strips along lateral edges of said webs.

3. The method of making resealable bags according to claim 2 further comprising the step of perforating said top and bottom webs along predetermined lines traversing said webs, defining lines of separation.

* * * * *